United States Patent [19]

Tsukamoto

[11] Patent Number: 4,552,351

[45] Date of Patent: Nov. 12, 1985

[54] BILL STORING MECHANISM FOR AUTOMATIC TELLER MACHINES

[75] Inventor: Katsura Tsukamoto, Ninomiya, Japan

[73] Assignee: International Business Machines Corporation, Armonk, N.Y.

[21] Appl. No.: 519,294

[22] Filed: Aug. 1, 1983

[30] Foreign Application Priority Data

Aug. 6, 1982 [JP] Japan ..... 57-136402

[51] Int. Cl.[4] ..... B65H 5/22

[52] U.S. Cl. ..... 271/3.1; 271/81; 271/160; 271/187; 271/201; 271/220; 271/315

[58] Field of Search ..... 271/3.1, 160, 187, 315, 271/220, 177, 178, 180, 181, 201, 81

[56] References Cited

U.S. PATENT DOCUMENTS

| | | | |
|---|---|---|---|
| 1,958,133 | 5/1934 | Delany | 271/201 |
| 3,584,869 | 6/1971 | Traphagen | 271/180 X |
| 3,908,985 | 9/1975 | Wiseman | 271/201 X |
| 4,456,234 | 6/1984 | Simonotti | 271/315 X |

*Primary Examiner*—Richard A. Schacher

*Attorney, Agent, or Firm*—Karl O. Hesse

[57] ABSTRACT

In a currency deposit and dispensing machine, a movable stacking assembly having a pair of paddle wheels is provided in the box for receiving the deposited bills. A predetermined box for receiving the deposited bills. A predetermined space is kept between the wheels and the top of the bills stacked in the box so that the received bills can be positively stacked in the box. On dispensing bills, the weight of the paddle wheel assembly is made to press against the top of the stacked bills so that the bills can be positively fed out one by one from the box through a feed port at the bottom of the box.

2 Claims, 3 Drawing Figures

BILL STORING MECHANISM FOR AUTOMATIC TELLER MACHINES

FIELD OF THE INVENTION

This invention relates to a paper money storing mechanism which can be used for a consumer transaction facility comprising an automatic bill depository and bill issuing mechanism often called an automatic teller machine.

DESCRIPTION OF THE PRIOR ART

A conventional automatic teller machine has two kinds of bill storing boxes, one for receiving bills inserted by customers for deposits and the other for storing bills to be dispensed to customers. Since it consists of a plurality of boxes each corresponding to a different denomination of bills, each box requires a sufficiently large capacity or large volume to reduce frequency of a bank clerk taking out the deposited bills and supplementing bills to be dispensed. In addition, since a large amount of bills are needed to be previously prepared in the boxes for dispensing and a large amount of deposited bills are kept idle in the boxes, this imposes a large burden on the bank.

To solve this problem, Japanese Published Unexamined Patent Application No. 56-33757 published on Apr. 4, 1981 discloses a bill storing mechanism with a plurality of bill boxes each associated with a different bill denomination. Each box can receive and stack deposited bills and can also feed them out for dispensing. The bill box is provided with levers for pressing the stacked bills to insure that they are positively fed out of the box. However, it is difficult for the lever to be made large enough to provide a sufficient pressure on the bills because the lever has to be lifted in order to slip down the subsequently deposited bills onto the stacked bills without breaking or disarranging the stack of deposited bills. Also the bills being stacked are not positively held but rely to some extent on gravity for stacking which can result in an uneven stack and later dispensing difficulty.

These same difficulties apply to the teachings of U.S. Pat. No. 4,365,700.

SUMMARY OF THE INVENTION

This invention solves the above disadvantages with a new type of bill storing mechanism, wherein each box is used to simultaneously store both the bills deposited and the bills to be dispensed. Namely, a movable stacking assembly having a pair of paddle wheels is provided in the box for receiving the deposited bills. A predetermined space is kept between the wheels and the top of the bills stacked in the box so that the received bills can be positively stacked in the box. On dispensing bills, the weight of the paddle wheel assembly is made to press against the top of the stacked bills so that the bills can be positively fed out one by one from the box through a feed port at the bottom of the box. Since the bills received for deposit can be utilized for dispensing as they are, the amount of bills kept idle in the box or in the bank is reduced. Also, because it is not necessary to enlarge the capacity of the box, it becomes possible to make its entire construction small. In addition, the deposited bills can be properly stacked in the box, so that they can be positively fed out of the bottom of the box.

A PREFERRED EMBODIMENT

Figure 1:
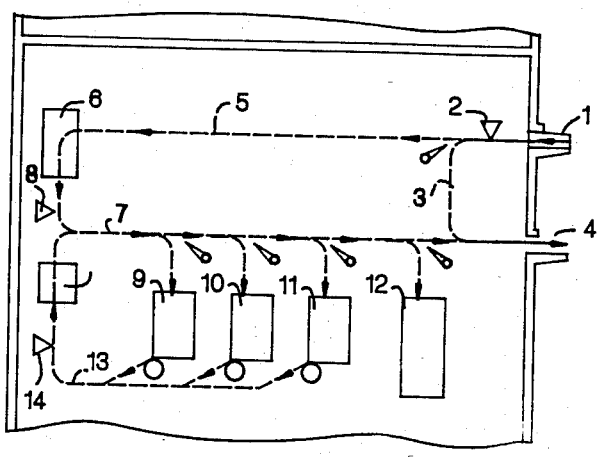
FIG. 1 schematically shows the bill feeding paths in an automatic teller machine in which this invention is embodied.

FIG. 1 schematically shows a bill feeding path in an automatic teller machine in which this invention is embodied. In the case of a deposit, the bills inserted through a bill receiving opening 1, are fed one by one and their denominations are sensed by a sensor 2. Any bill determined to be unacceptable, for example a false note, is returned to an exit port 4 through a feeding path 3. If the bill is acceptable, it is accumulated in an escrow or temporary store box 6 through a feeding path 5. Because the bills to be deposited are successively fed from the bill receiving opening 1 and accumulated in the temporary store box 6, if the depositor wishes to cancel the deposit, all of the bills accumulated in the box 6 can be returned to the exit port 4 through a feeding path 7. If the depositor agrees to deposit all of the bills accumulated in the box 6, these bills are fed out to the feeding path 7, again one by one, sensed by sensor 8, sorted by their denominations, and received in bill storing mechanisms 9, 10, and 11, each corresponding to a different denomination respectively. When any one of these bill storing mechanisms receives the bills up to its full capacity, the later bills associated with the denomination are fed to an auxiliary storing box 12.

On dispensing bills, each of the bills storing mechanisms 9, 10, and 11 feeds out the specified number of bills to a feeding path 13. The denomination of these bills are then confirmed by a sensor 14 and they are accumulated in a temporary stack 15. If the sensor 14 detects any abnormal condition such as overlapped bills, all of the bills in the stack 15 are forwarded to the auxiliary box 12 and then the dispense operation is repeated. However, when the sensor 14 does not detect such error, the bills in the stack 15 are fed to the exit port 4 to be issued to the customer.

Figure 2:
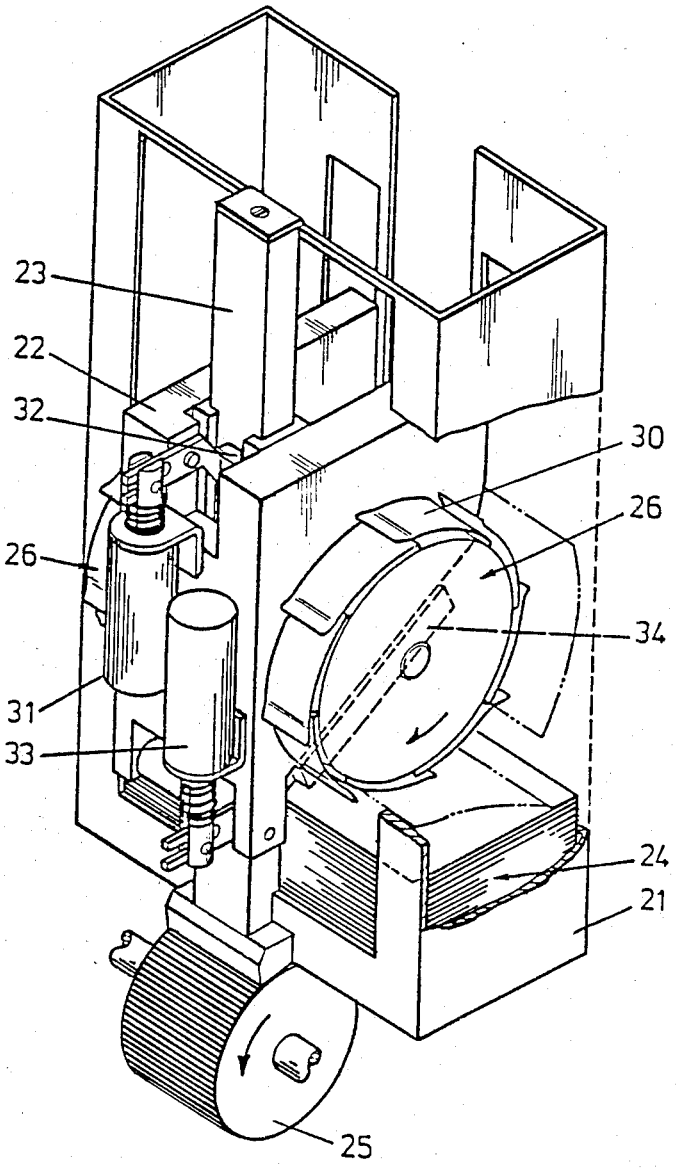
FIG. 2 is a partially broken perspective view of an embodiment of the invention.
Figure 3:
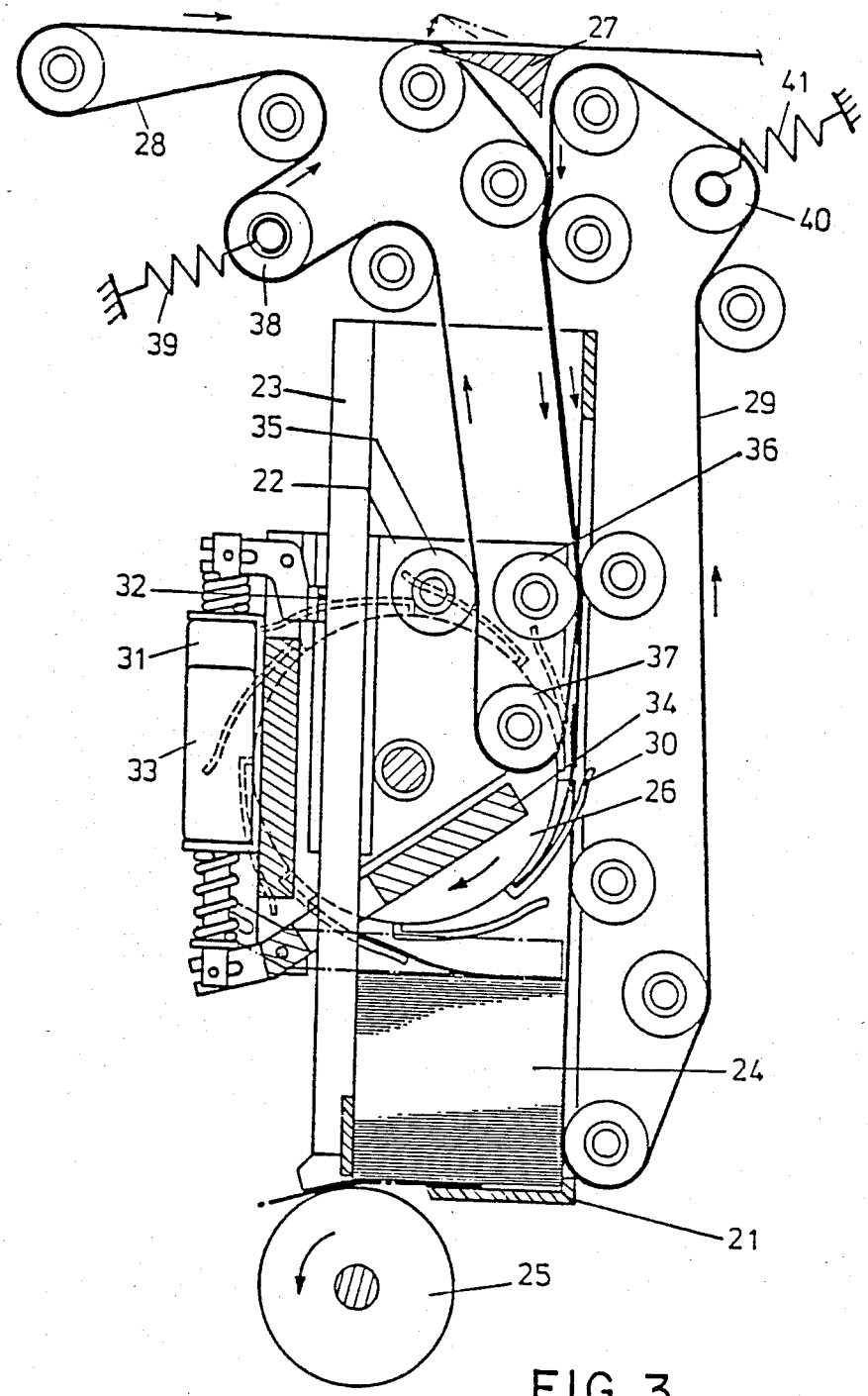
FIG. 3 is a cross sectional view of the embodiment of this invention shown in FIG. 2.

FIGS. 2 and 3 show in detail one of the bill storing mechanisms 9, 10, and 11 in FIG. 1. In a casing or box 21, a paddle wheel assembly 22 is provided and is vertically slidable along a guide bar 23. There is provided at the bottom of the casing 21, a rotatable separator 25 to feed out the bills 24 stacked in the casing one by one. Provided on each side of the paddle wheel assembly 22 is a pair of paddle wheels 26 that can rotate at a constant speed.

In the case of a deposit, a bill fed through the temporary store box 6 (FIG. 1), is deflected downwardly by the action of a deflector plate 27 and fed into the casing 21 through its upper opening while being held between feed belts 28 and 29. Then, the bill is received by a blade 30 of the wheels 26, transferred to the lower part of the wheel assembly 22 by the rotation of the wheels 26, released therefrom when the front edge of the bill strikes against the inner wall of the casing 21, and positively stacked in the casing 21 like the bills 24. When the bills are being fed into the casing 21 as described above, a solenoid 31 is kept energized to press a brake shoe 32 against the guide bar 23, and therefore the paddle wheel assembly 22 is held in place above the stack of bills against the force of gravity. In order to prevent the rotating wheels 26 from contacting the stacked bills 24, when a predetermined number of the bills are fed into the casing 21, the feeding of the bills from the store box 6 is temporarily stopped and the solenoid 31 is deenergized to release the brake shoe 32 from the guide bar 23. At the same time, a solenoid 33 is actuated to move a plate 34 against the top of the stacked bills 24. As the brake shoe 32 is released, the paddle wheel assembly 22 becomes movable along the guide bar 23 and, therefore, the weight of the paddle wheel assembly 22 is imposed to press against the bills 24 through the plate 34. In reaction to the pressing, the paddle wheel assembly 22 is lifted up. Then, by reactivating the solenoid 31, the brake shoe 32 is actuated to hold the paddle wheel assembly 22 at its new lifted position. Thereafter, the plate 34 is caused to leap up by the solenoid 33 being released. Thereby, a predetermined space between the wheel 26 and the upper surface of the bills 24 is provided, and it becomes possible to feed the bills into the casing 21 again. By repeating this operation, the bills can be positively stacked in the casing 21. When the paddle wheel assembly has been raised to the top of casing 21, bills are transported past this casing and sent to auxiliary box 12.

In the case of feeding out the bills from the casing 21 for dispensing, the solenoid 31 is deenergized to release the brake shoe 32, and, at the same time, the solenoid 33 is energized to place the plate 34 on the top of the bills 24, whereby the weight of the paddle wheel assembly 22 is imposed on the bills 24. Thus, the bills can be successively and positively fed out from the bottom of the casing 21 when rotating the separator 25.

The actuations of the separator 25, the deflector 27 and a motor (not shown) for driving the belts 28 and 29 and the energizing of the solenoids 31 and 33 are under the control of a microprocessor incorporated in the automatic teller machine in a convention manner well known to those skilled in the art of teller machine design.

The variable length transport for transporting bills between feed path 7 and paddle wheels 26 will now be described. Pulleys 35, 36 and 37 over which a belt 28 is stretched are mounted on the paddle wheel assembly 22 and the other pulleys are mounted on the frame of the machine. Further, a movable pulley 38 is mounted on the frame through a spring 39 to retain a predetermined tension on the belt 28 during the vertical movement of the paddle wheel assembly 22. Similarly, a pulley 40 for a belt 29 is also mounted on the frame through a spring 41 to retain the belt tension. All of the other pulleys on the belt 29 are mounted on the machine frame or the casing 21. The wheel 26 may be rotated by the belt 28 through pulley 37 and gears or the like, or by a driving motor which is mounted in the paddle wheel assembly 22.

The above-mentioned embodiment discloses a mechanism for pressing the bills in the casing 21 with the weight of the paddle wheel assembly 22 to stack the bills in the vertical direction. However, if it is desired to stack the bills in the horizontal direction, it is only required to mount the mechanism horizontally and, at the same time, to bias the paddle wheel assembly 22 toward the stacked bills 24 by a spring or a motor with clutch, whereby the present invention can be effectively embodied in a horizontal stacker. Although two paddle wheels 26 and a single press plate 34 is shown, a single paddle wheel and a plurality of press plates or an aperatured press plate could be used. Also it will be understood that other modifications may be made without departing from the spirit and scope of the invention.

I claim:

1. A bill storing mechanism for an automatic teller machine comprising:

a bill feed path;

a bill receiving casing;

a paddle wheel assembly having at least one paddle wheel in said casing for receiving a bill and positively stacking said bill in said casing;

variable length transport means between said feed path and said paddle wheel for transporting said bill from said feed path to said paddle wheel;

guide means for slidably guiding said paddle wheel assembly in the direction of bills being stacked in said casing;

press means for pressing the most recently stacked bills against the stack to move the paddle wheel assembly away from the stack and at the same time provide a uniform pressure on the stack to permit reliable feeding of bills from the other end of the stack.

2. The bill storing mechanism of claim 1 wherein said paddle wheel assembly further comprises;

brake means for holding said paddle wheel assembly in a position away from the stack to which it was moved by said press means.

* * * * *